US007709423B2

(12) United States Patent
Esche, Jr. et al.

(10) Patent No.: US 7,709,423 B2
(45) **Date of Patent: *May 4, 2010**

(54) ADDITIVES AND LUBRICANT FORMULATIONS FOR PROVIDING FRICTION MODIFICATION

(75) Inventors: Carl K. Esche, Jr., Richmond, VA (US); Mark T. Devlin, Richmond, VA (US); Tze-Chi Jao, Glen Allen, VA (US)

(73) Assignee: Afton Chemical Corporation, Richmond, VA (US)

( * ) Notice: Subject to any disclaimer, the term of this patent is extended or adjusted under 35 U.S.C. 154(b) by 654 days.

This patent is subject to a terminal disclaimer.

(21) Appl. No.: 11/280,696

(22) Filed: Nov. 16, 2005

(65) Prior Publication Data

US 2007/0111907 A1 May 17, 2007

(51) Int. Cl.
*C10M 129/26* (2006.01)
*C10M 125/00* (2006.01)

(52) U.S. Cl. ..... 508/165; 508/179; 123/1 A

(58) Field of Classification Search ..... 508/364, 508/165, 179; 123/1 A
See application file for complete search history.

(56) References Cited

U.S. PATENT DOCUMENTS 2,055,417 A * 9/1936 Moser ..... 508/539
2,160,273 A 5/1939 Loane et al.
2,384,577 A 9/1945 Thomas
2,621,195 A 12/1952 Haslam
2,710,872 A 6/1955 Thompson
2,719,125 A 9/1955 Roberts
2,719,126 A 9/1955 Fields et al.
2,786,866 A 3/1957 Hook et al.
2,897,152 A 7/1959 Elliott et al.
2,960,469 A 11/1960 Young
2,995,569 A 8/1961 Hamilton et al.
3,017,361 A * 1/1962 Lawrence et. al. ..... 508/539
3,087,932 A 4/1963 Lille, Jr.
3,219,666 A 11/1965 Norman et al.
3,277,002 A 10/1966 Hunt et al.
3,356,702 A 12/1967 Farmer et al.
3,399,139 A 8/1968 Forbes et al.
3,407,222 A 10/1968 Lies
3,445,386 A 5/1969 Otto et al.
3,458,548 A 7/1969 Carlson
3,509,051 A 4/1970 Farmer et al.
3,565,804 A 2/1971 Honnen et al.
3,673,090 A 6/1972 Walbillig et al.
3,697,574 A 10/1972 Piasek et al.
3,699,118 A 10/1972 Donham
3,703,504 A 11/1972 Horodysky
3,703,505 A 11/1972 Horodysky et al.
3,736,357 A 5/1973 Piasek et al.
3,758,493 A 9/1973 Maddox, Jr.
3,762,890 A 10/1973 Collins
3,794,081 A 2/1974 Fiser et al.
3,796,661 A 3/1974 Suratwala et al.
3,821,236 A 6/1974 Ripple
3,867,359 A 2/1975 Beadle
3,873,454 A 3/1975 Horodysky et al.
3,904,537 A 9/1975 Ripple
3,969,281 A 7/1976 Sharp
4,029,587 A 6/1977 Koch
4,097,387 A 6/1978 Caspari
4,098,705 A 7/1978 Sakurai et al.
4,107,059 A 8/1978 King et al.
4,122,033 A 10/1978 Black
4,136,043 A 1/1979 Davis
4,164,473 A 8/1979 Coupland et al.
4,171,268 A 10/1979 Collins
4,176,073 A 11/1979 Ryer et al.
4,176,074 A 11/1979 Coupland et al.
4,178,258 A 12/1979 Papay et al.
4,188,299 A 2/1980 Caspari
4,192,757 A 3/1980 Brewster
4,193,882 A 3/1980 Gemmill, Jr.
4,210,683 A 7/1980 Praxl et al.
4,234,435 A 11/1980 Meinhardt et al.
4,248,720 A 2/1981 Coupland et al.
4,259,195 A 3/1981 King et al.
4,261,843 A 4/1981 King et al.
4,263,152 A 4/1981 King et al.
4,265,773 A 5/1981 de Vries et al.
4,266,945 A 5/1981 Karn
4,272,387 A 6/1981 King et al.
4,283,295 A 8/1981 de Vries et al.
4,285,822 A 8/1981 de Vries et al.

(Continued)

FOREIGN PATENT DOCUMENTS

EP 330522 12/1994

(Continued)

*Primary Examiner*—Glenn Caldarola
*Assistant Examiner*—Jim Goloboy
(74) *Attorney, Agent, or Firm*—Luedeka, Neely & Graham, PC

(57) ABSTRACT

Lubricated surfaces, lubricant compositions for lubricating a surface, and methods for reducing friction coefficients in lubricants. The lubricated surface is provided by a lubricant composition containing a base oil of lubricating viscosity and an amount of at least one hydrocarbon soluble titanium compound effective to provide a reduction in the coefficient of friction of the lubricant composition greater than a reduction in the coefficient of friction of the lubricant composition devoid of the hydrocarbon soluble titanium compound.

24 Claims, No Drawings

U.S. PATENT DOCUMENTS 4,362,633 A 12/1982 Spence et al.
4,363,322 A 12/1982 Andersson
4,369,119 A 1/1983 de Vries et al.
4,383,931 A 5/1983 Ryu et al.
4,395,343 A 7/1983 De Vries et al.
4,402,840 A 9/1983 de Vries et al.
4,466,901 A 8/1984 Hunt et al.
4,479,883 A 10/1984 Shaub et al.
4,517,114 A 5/1985 Oppenlaender et al.
4,555,352 A 11/1985 Garner et al.
4,636,322 A 1/1987 Nalesnik
4,654,156 A 3/1987 Horodysky et al.
4,692,256 A 9/1987 Umemura et al.
4,702,850 A 10/1987 Gutierrez et al.
4,713,184 A 12/1987 Zaid
4,758,362 A 7/1988 Butke
4,765,918 A 8/1988 Love et al.
4,824,611 A 4/1989 Cells
4,837,190 A 6/1989 Summers, III et al.
4,838,931 A 6/1989 Liebl et al.
4,849,123 A 7/1989 Tipton et al.
4,857,214 A 8/1989 Papay et al.
4,867,890 A 9/1989 Colclough et al.
4,876,375 A 10/1989 Lam
4,885,365 A 12/1989 Lam
4,889,647 A 12/1989 Rowan et al.
4,904,401 A 2/1990 Ripple et al.
4,927,552 A 5/1990 Lam
4,938,880 A 7/1990 Waddoups et al.
4,957,643 A 9/1990 Lam
4,957,649 A 9/1990 Ripple et al.
4,962,256 A 10/1990 Le et al.
4,966,719 A 10/1990 Coyle et al.
4,978,464 A 12/1990 Coyle et al.
4,990,271 A 2/1991 Francis
4,995,996 A 2/1991 Coyle et al.
5,000,863 A 3/1991 Watanabe
5,027,901 A 7/1991 French et al.
5,055,211 A 10/1991 Habeeb et al.
5,110,488 A * 5/1992 Tipton et al. ..... 508/192
5,137,647 A 8/1992 Karol
5,204,012 A 4/1993 Schaffhausen
5,242,613 A 9/1993 Ozbalik et al.
5,260,466 A 11/1993 McGibbon
5,286,394 A 2/1994 Moore
5,287,731 A 2/1994 Florkowski et al.
5,292,480 A 3/1994 Fischer et al.
5,322,640 A 6/1994 Byrne et al.
5,328,620 A 7/1994 Ripple
5,387,351 A * 2/1995 Kumar et al. ..... 508/165
5,401,661 A 3/1995 Florkowski et al.
5,412,130 A 5/1995 Karol
5,484,542 A 1/1996 Cahoon et al.
5,486,300 A 1/1996 Salomon et al.
5,490,945 A 2/1996 Smith et al.
5,562,864 A 10/1996 Salomon et al.
5,627,259 A 5/1997 Thaler et al.
5,633,326 A 5/1997 Patil et al.
5,643,859 A 7/1997 Gutierrez et al.
5,652,201 A * 7/1997 Papay et al. ..... 508/228
5,686,397 A 11/1997 Baranski et al.
5,693,598 A 12/1997 Abraham et al.
5,747,430 A 5/1998 Matsushita et al.
5,753,596 A 5/1998 Martin et al.
5,759,485 A 6/1998 Fischer et al.
5,773,391 A 6/1998 Lawate et al.
5,789,357 A 8/1998 Baranski et al.
5,792,729 A 8/1998 Harrison et al.
5,851,965 A 12/1998 Harrison et al.
5,853,434 A 12/1998 Harrison et al.
5,902,776 A 5/1999 Dohner et al.
5,936,041 A 8/1999 Diana et al.
5,939,362 A 8/1999 Johnson et al.
6,034,040 A 3/2000 Ozbalik et al.
6,074,444 A 6/2000 Bingley
6,096,691 A 8/2000 Conary et al.
6,103,674 A 8/2000 Nalesnik et al.
6,114,288 A 9/2000 Fujitsu et al.
6,117,826 A 9/2000 Baranski et al.
6,172,012 B1 1/2001 Kumar et al.
6,232,276 B1 5/2001 Stiefel et al.
6,268,316 B1 * 7/2001 Tanaka et al. ..... 508/291
6,300,291 B1 10/2001 Hartley et al.
6,338,819 B1 1/2002 Braga et al.
6,509,303 B1 1/2003 Gatto
6,528,463 B1 3/2003 Gatto et al.
6,599,472 B1 7/2003 Hudson
6,599,865 B1 7/2003 Esche, Jr. et al.
6,723,685 B2 4/2004 Hartley et al.
6,797,677 B2 9/2004 Esche, Jr. et al.
6,800,594 B2 10/2004 Miksic et al.
2002/0119895 A1 * 8/2002 Cook et al. ..... 508/186
2004/0200996 A1 10/2004 Meyer
2004/0204325 A1 10/2004 Takahashi
2004/0266630 A1 12/2004 George et al.
2006/0217271 A1 * 9/2006 Brown et al. ..... 508/165

FOREIGN PATENT DOCUMENTS

EP 874040 10/1998
EP 0995790 4/2000
GB 866054 4/1961
GB 885679 12/1961
GB 997335 7/1965
GB 1560830 2/1980
JP 61-111397 5/1986
JP 62236894 10/1987
JP 03-190997 A 8/1991
JP 10-259392 A 9/1998
JP 11-131084 A 5/1999
JP 2002-302691 10/2002
JP 2004149762 5/2004
JP 2004-182829 A 7/2004
SU 1669975 A 8/1991
SU 1669976 A 8/1991
WO WO 87/04454 7/1987
WO WO 9811181 3/1998
WO WO 02092734 11/2002

* cited by examiner

ADDITIVES AND LUBRICANT FORMULATIONS FOR PROVIDING FRICTION MODIFICATION

TECHNICAL FIELD

The embodiments described herein relate to particular oil soluble titanium additives and use of such titanium additives in lubricant oil formulations, and in particular to oil soluble titanium additives used as friction modifiers for lubricant formulations.

BACKGROUND

Lubricating oils used in passenger cars and heavy duty diesel engines have changed over the years. Today's engines are designed to run hotter and harder than in the past. Various additives have been added to lubricant formulations in order to reduce friction between moving parts. One particularly common additive is the organo-molybdenum additive. While such molybdenum additives are particularly useful as friction modifiers, such molybdenum friction modifiers may have one or more of the following disadvantages: poor oil solubility; copper and/or lead corrosion; color darkening of the finished lubricant; and increased levels of sulfur and/or phosphorus in the finished lubricant.

Future generations of passenger car motor oils and heavy duty diesel engine oils require lower levels of phosphorus and sulfur in the finished oil in order to protect pollution control devices as it is well known that sulfur and phosphorus containing additives may poison or otherwise reduce the effectiveness of pollution control devices. For example, current GF-4 motor oil specifications require a finished oil to contain less than 0.08 wt % and 0.7 wt % phosphorus and sulfur, respectively, and PC-10 motor oil specifications, the next generation heavy duty diesel engine oil, requires oils to contain less than 0.12 wt % and 0.4 wt % phosphorus and sulfur, respectively, and 1.0 wt % sulfated ash. Certain molybdenum additives known in the industry contain phosphorus and sulfur at levels which reduce the effectiveness of pollution control devices.

Therefore, a need exists for lubricant additives and compositions that provide enhanced friction reducing properties and which are more compatible with pollution control devices used for automotive and diesel engines. A need also exists for such lubricant additives and compositions which are more compatible with such pollution control devices without adversely affecting oil solubility, corrosion, and/or darkening the color of the finished lubricant. Such additives may contain phosphorus and/or sulfur or may be substantially devoid of phosphorus and/or sulfur.

SUMMARY OF THE EMBODIMENTS

In one embodiment herein is presented a lubricated surface containing a lubricant composition comprising a base oil of lubricating viscosity and an amount of at least one hydrocarbon soluble titanium compound effective to provide a reduction in the coefficient of friction of the lubricant composition greater than a reduction in the coefficient of friction of the lubricant composition devoid of the hydrocarbon soluble titanium compound.

In another embodiment, there is provided a vehicle having moving parts and containing a lubricant for lubricating the moving parts. The lubricant comprises an oil of lubricating viscosity having therein first and second friction modifiers. The first friction modifier is selected from the group consisting essentially of an organomolybdenum friction modifier, a glycerol ester friction modifier, and mixtures thereof. The second friction modifier contains an amount of at least one hydrocarbon soluble titanium compound effective to provide a reduction in the friction coefficient of the lubricant composition greater than a reduction in the friction coefficient of the lubricant composition devoid of the hydrocarbon soluble titanium compound. The hydrocarbon soluble titanium compound is essentially devoid of sulfur and phosphorus atoms.

In yet another embodiment there is provided a fully formulated lubricant composition comprising a base oil component of lubricating viscosity having therein first and second friction modifiers. The first friction modifier is selected from the group consisting essentially of an organomolybdenum friction modifier, a glycerol ester friction modifier, and mixtures thereof. The second friction modifier contains an amount of hydrocarbon soluble titanium-containing compound effective to provide a reduction in the friction coefficient of the lubricant composition greater than a reduction in the friction coefficient of the lubricant composition devoid of the hydrocarbon soluble titanium-containing compound. The titanium-containing compound used as the second friction modifier is essentially devoid of sulfur and phosphorus atoms.

A further embodiment of the disclosure provides a method of lubricating moving parts with a lubricating oil. The method includes using as the lubricating oil for one or more moving parts a lubricant composition comprising a base oil having therein first and second friction modifiers. The first friction modifier is selected from the group consisting essentially of an organomolybdenum friction modifier, a glycerol ester friction modifier, and mixtures thereof. The second friction modifier is a reaction product of a titanium alkoxide and a about $C_6$ to about $C_{25}$ carboxylic acid. As used therein, the second friction modifier is effective to provide from above about 500 to about 1000 parts per million titanium in the lubricating oil.

As set forth briefly above, embodiments of the disclosure provide a hydrocarbon soluble titanium compound that may significantly improve the coefficient of friction of a lubricant composition and may enable a decrease in the amount of phosphorus and sulfur additives required for equivalent friction improving characteristics. The additive may be mixed with an oleaginous fluid that is applied to a surface between moving parts. In other applications, the additive may be provided in a fully formulated lubricant composition. The additive is particularly directed to meeting the currently proposed GF-4 standards for passenger car motor oils and PC-10 standards for heavy duty diesel engine oils, as well as future passenger car and diesel engine oil specifications and standards.

The compositions and methods described herein are particularly suitable for maintaining the effectiveness of pollution control devices on motor vehicles or, in the alternative, the compositions and methods are suitable for improving the friction coefficient characteristics of lubricant formulations. Other features and advantages of the compositions and methods described herein may be evident by reference to the following detailed description which is intended to exemplify aspects of the embodiments without intending to limit the embodiments described herein.

It is to be understood that both the foregoing general description and the following detailed description are exemplary and explanatory only and are intended to provide further explanation of the embodiments disclosed and claimed.

DETAILED DESCRIPTION OF EMBODIMENTS

In one embodiment is presented a novel composition useful as a component in lubricating oil compositions. The composition comprises a hydrocarbon soluble titanium compound that may be used in addition to or as a partial or total replacement for conventional friction modifiers containing phosphorus and sulfur.

The primary component of the additives and concentrates provided for lubricant compositions is the hydrocarbon soluble titanium compound. The term "hydrocarbon soluble" means that the compound is substantially suspended or dissolved in a hydrocarbon material, as by reaction or complexation of a reactive titanium compound with a hydrocarbon material. As used herein, "hydrocarbon" means any of a vast number of compounds containing carbon, hydrogen, and/or oxygen in various combinations.

The term "hydrocarbyl" refers to a group having a carbon atom attached to the remainder of the molecule and having predominantly hydrocarbon character.

Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, and sulfoxy);

(3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

The hydrocarbon soluble titanium compounds suitable for use as a friction modifier are provided by a reaction product of a titanium alkoxide and a about $C_6$ to about $C_{25}$ carboxylic acid. The reaction product may be represented by the following formula:

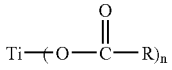

wherein n is an integer selected from 2, 3 and 4, and R is a hydrocarbyl group containing from about 5 to about 24 carbon atoms, or by the formula:

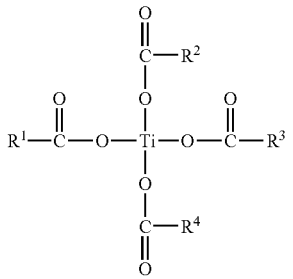

wherein each of $R^1$, $R^2$, $R^3$, and $R^4$ are the same or different and are selected from a hydrocarbyl group containing from about 5 to about 25 carbon atoms. Compounds of the foregoing formulas are essentially devoid of phosphorous and sulfur.

In an embodiment, the hydrocarbon soluble titanium compound may be substantially or essentially devoid or free of sulfur and phosphorus atoms such that a lubricant or formulated lubricant package comprising the hydrocarbon soluble titanium compound contains about 0.7 wt % or less sulfur and about 0.12 wt % or less phosphorus.

In another embodiment, the hydrocarbon soluble titanium compound may be substantially free of active sulfur. "Active" sulfur is sulfur which is not fully oxidized. Active sulfur further oxidizes and becomes more acidic in the oil upon use.

In yet another embodiment, the hydrocarbon soluble titanium compound may be substantially free of all sulfur. In a further embodiment, the hydrocarbon soluble titanium compound may be substantially free of all phosphorus. In a still further embodiment, the hydrocarbon soluble titanium compound may be substantially free of all sulfur and phosphorus. For example, the base oil in which the titanium compound may be dissolved in could contain relatively small amounts of sulfur, such as in one embodiment, less than about 0.5 wt % and in another embodiment, about 0.03 wt % or less sulfur (e.g., for Group II base oils), and in a still further embodiment, the amount of sulfur and/or phosphorus may be limited to an amount which is necessary to make the compound while still permitting the finished oil to meet the appropriate motor oil sulfur and/or phosphorus specifications in effect at a given time.

Examples of titanium/carboxylic acid products include, but are not limited to, titanium reaction products with acids selected from the group consisting essentially of caproic acid, caprylic acid, lauric acid, myristic acid, palmitic acid, stearic acid, arachidic acid, oleic acid, erucic acid, linoleic acid, linolenic acid, cyclohexanecarboxylic acid, phenylacetic acid, benzoic acid, neodecanoic acid, and the like. Methods for making such titanium/carboxylic acid products are described, for example, in U.S. Pat. No. 5,260,466, the disclosure of which is incorporated herein by reference.

The hydrocarbon soluble titanium compounds of the embodiments described herein are advantageously incorporated into lubricating compositions. Accordingly, the hydrocarbon soluble titanium compounds may be added directly to the lubricating oil composition. In one embodiment, however, hydrocarbon soluble titanium compounds are diluted with a substantially inert, normally liquid organic diluent such as mineral oil, synthetic oil (e.g., ester of dicarboxylic acid), naptha, alkylated (e.g., $C_{10}$-$C_{13}$ alkyl) benzene, toluene or xylene to form a metal additive concentrate. The titanium additive concentrates usually contain from about 0% to about 99% by weight diluent oil.

In the preparation of lubricating oil formulations it is common practice to introduce the titanium additive concentrates in the form of about 1 to about 99 wt. % active ingredient concentrates in hydrocarbon oil, e.g. mineral lubricating oil, or other suitable solvent. Usually these concentrates may be added to a lubricating oil with a dispersant/inhibitor (DI) additive package and viscosity index (VI) improvers containing about 0.01 to about 50 parts by weight of lubricating oil per part by weight of the DI package to form finished lubricants, e.g., crankcase motor oils. Suitable DI packages are described, for example, in U.S. Pat. Nos. 5,204,012 and 6,034,040, the disclosures of which are herein incorporated by reference. Among the types of additives which may be included in the DI additive package are detergents, dispersants, antiwear agents, friction modifiers, seal swell agents, antioxidants, foam inhibitors, lubricity agents, rust inhibitors, corrosion inhibitors, demulsifiers, pour point depressants, viscosity index improvers, and the like. Several of these components are well known to those skilled in the art and may be used in conventional amounts with the additives and compositions described herein.

In another embodiment, the titanium additive concentrates may be top treated into a fully formulated motor oil or finished lubricant. The purpose of combining the titanium additive concentrates and DI package, of course, is to make the handling of the various materials less difficult and awkward as well as to facilitate solution or dispersion in the final blend.

Embodiments described herein provide lubricating oils and lubricant formulations in which the concentration of the hydrocarbon soluble titanium compound is relatively low, providing from about 10 to about 1500 parts per million (ppm) titanium in the finished lubricant composition. In one embodiment, the metal compound is present in the lubricating oil compositions in an amount sufficient to provide from above about 500 to about 1000 ppm titanium. In another embodiment, the amount of titanium compound in the finished lubricant is an amount that is effective to provide a reduction in the friction coefficient of the lubricant composition greater than a reduction in the friction coefficient of the lubricant composition devoid of the titanium compound. In still other embodiments, the titanium compound may be used alone or in combination with one or more conventional friction modifiers, such as organomolybdenum compounds and/or glycerol esters.

Lubricant compositions made with the hydrocarbon soluble titanium additive described above are used in a wide variety of applications. For compression ignition engines and spark ignition engines, it is preferred that the lubricant compositions meet or exceed published GF-4 or API-CI-4 standards. Lubricant compositions according to the foregoing GF-4 or API-CI-4 standards include a base oil, the DI additive package, and/or a VI improver to provide a fully formulated lubricant. The base oil for lubricants according to the disclosure is an oil of lubricating viscosity selected from the group consisting essentially of mineral oils, synthetic lubricating oils, vegetable oils and mixtures thereof. Such base oils include those conventionally employed as crankcase lubricating oils for spark-ignited and compression-ignited internal combustion engines, such as automobile and truck engines, marine and railroad diesel engines, and the like. Such base oils are typically classified as Group I, Group II, Group III, Group IV and Group V, as described in Table 1 below.

TABLE 1

Group I–V Base Oils

| Base Oil | % Sulfur | | % Saturates | Viscosity Index |
|---|---|---|---|---|
| Group I | >0.03 | and/or | <90 | 80–120 |
| Group II | ≦0.03 | and/or | ≧90 | 80–120 |
| Group III | ≦0.03 | and/or | ≧90 | ≧120 |
| Group IV | * | | | |
| Group V | ** | | | |

* Group IV base oils are defined as all polyalphaolefins

** Group V base oils are defined as all other base oils not included in Groups I, II, III and IV Dispersant Components Dispersants contained in the DI package may include, but are not limited to, an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. Dispersants may be selected from Mannich dispersants as described, for example, in U.S. Pat. Nos. 3,697,574 and 3,736,357; ashless succcinimide dispersants as described in U.S. Pat. Nos. 4,234,435 and 4,636,322; amine dispersants as described in U.S. Pat. Nos. 3,219,666, 3,565,804, and 5,633,326; Koch dispersants as described in U.S. Pat. Nos. 5,936,041, 5,643,859, and 5,627,259, and polyalkylene succinimide dispersants as described in U.S. Pat. Nos. 5,851,965; 5,853,434; and 5,792,729.

Oxidation Inhibitor Components

Oxidation inhibitors, or antioxidants, reduce the tendency of base stocks to deteriorate in service, which deterioration can be evidenced by the products of oxidation such as sludge and varnish-like deposits that deposit on metal surfaces and by viscosity growth of the finished lubricant. Such oxidation inhibitors include, but are not limited to, hindered phenols, sulfurized hindered phenols, alkaline earth metal salts of alkylphenolthioesters having about $C_5$ to about $C_{12}$ alkyl side chains, sulfurized alkylphenols, metal salts of either sulfurized or nonsulfurized alkylphenols, for example calcium nonylphenol sulfide, ashless oil soluble phenates and sulfurized phenates, phosphosulfurized or sulfurized hydrocarbons, phosphorus esters, metal thiocarbamates, and oil soluble copper compounds as described in U.S. Pat. No. 4,867,890.

Other antioxidants that may be used include sterically hindered phenols and diarylamines, alkylated phenothiazines, sulfurized compounds, and ashless dialkyldithiocarbamates. Non-limiting examples of sterically hindered phenols include, but are not limited to, 2,6-di-tertiary butylphenol, 2,6 di-tertiary butyl methylphenol, 4-ethyl-2,6-di-tertiary butylphenol, 4-propyl-2,6-di-tertiary butylphenol, 4-butyl-2,6-di-tertiary butylphenol, 4-pentyl-2,6-di-tertiary butylphenol, 4-hexyl-2,6-di-tertiary butylphenol, 4-heptyl-2,6-di-tertiary butylphenol, 4-(2-ethylhexyl)-2,6-di-tertiary butylphenol, 4-octyl-2,6-di-tertiary butylphenol, 4-nonyl-2,6-di-tertiary butylphenol, 4-decyl-2,6-di-tertiary butylphenol, 4-undecyl-2,6-di-tertiary butylphenol, 4-dodecyl-2,6-di-tertiary butylphenol, methylene bridged sterically hindered phenols including, but not limited to, 4,4-methylenebis(6-tert-butyl-o-cresol), 4,4-methylenebis(2-tert-amyl-o-cresol), 2,2-methylenebis(4-methyl-6 tert-butylphenol, 4,4-methylene-bis(2,6-di-tert-butylphenol) and mixtures thereof as described in U.S. Publication No. 2004/0266630.

Diarylamine antioxidants include, but are not limited, to diarylamines having the formula:

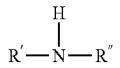

wherein R' and R" each independently represents a substituted or unsubstituted aryl group having from about 6 to about 30 carbon atoms. Illustrative of substituents for the aryl group, but are not limited to, include aliphatic hydrocarbon groups such as alkyl having from about 1 to about 30 carbon atoms, hydroxy groups, halogen radicals, carboxylic acid or ester groups, or nitro groups.

The aryl group is may be substituted or unsubstituted phenyl or naphthyl. In one embodiment, one or both of the aryl groups are substituted with at least one alkyl group having from about 4 to about 30 carbon atoms. In another embodiment, one or both of the aryl groups are substituted with at least one alkyl group having from about 4 to about 18 carbon atoms. In yet another embodiment, one or both of the aryl groups are substituted with at least one alkyl group having from about 4 to about 9 carbon atoms. In still yet another embodiment, one or both of the aryl groups are substituted, e.g. mono-alkylated diphenylamine, di-alkylated diphenylamine, or mixtures of mono- and di-alkylated diphenylamines.

The diarylamines may be of a structure containing more than one nitrogen atom in the molecule. Thus, the diarylamine may contain at least two nitrogen atoms wherein at least one nitrogen atom has two aryl groups attached thereto, e.g., as in the case of various diamines having a secondary nitrogen atom as well as two aryls on one of the nitrogen atoms.

Examples of diarylamines that may be used include, but are not limited to: diphenylamine; various alkylated diphenylamines; 3-hydroxydiphenylamine; N-phenyl-1,2-phenylenediamine; N-phenyl-1,4-phenylenediamine; monobutyldiphenyl-amine; dibutyldiphenylamine; monooctyldiphenylamine; dioctyldiphenylamine; monononyldiphenylamine; dinonyldiphenylamine; monotetradecyldiphenylamine; ditetradecyldiphenylamine, phenyl-alpha-naphthylamine; monooctyl phenyl-alpha-naphthylamine; phenyl-beta-naphthylamine; monoheptyldiphenylamine; diheptyl-diphenylamine; p-oriented styrenated diphenylamine; mixed butyloctyldiphenylamine; and mixed octylstyryldiphenylamine.

Another class of aminic antioxidants includes phenothiazine or alkylated phenothiazine having the chemical formula:

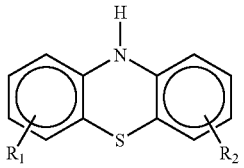

wherein $R_1$ is a linear or branched about $C_1$ to about $C_{24}$ alkyl, aryl, heteroalkyl or alkylaryl group and $R_2$ is hydrogen or a linear or branched about $C_1$-about $C_{24}$ alkyl, heteroalkyl, or alkylaryl group. Alkylated phenothiazine may be selected from the group consisting essentially of monotetradecylphenothiazine, ditetradecylphenothiazine, monodecylphenothiazine, didecylphenothiazine, monononylphenothiazine, dinonylphenothiazine, monoctyl-phenothiazine, dioctylphenothiazine, monobutylphenothiazine, dibutylphenothiazine, monostyrylphenothiazine, distyrylphenothiazine, butyloctylphenothiazine, and styryloctylphenothiazine.

The sulfur containing antioxidants include, but are not limited to, sulfurized olefins that are characterized by the type of olefin used in their production and the final sulfur content of the antioxidant. In one embodiment, high molecular weight olefins, i.e. those olefins having an average molecular weight of about 168 to about 351 g/mole, may be used. Non-limiting examples of olefins that may be used include alpha-olefins, isomerized alpha-olefins, branched olefins, cyclic olefins, and combinations of these.

Alpha-olefins include, but are not limited to, any about $C_4$ to about $C_{25}$ alpha-olefins. Alpha-olefins may be isomerized before the sulfurization reaction or during the sulfurization reaction. Structural and/or conformational isomers of the alpha olefin that contain internal double bonds and/or branching may also be used. For example, isobutylene is a branched olefin counterpart of the alpha-olefin 1-butene.

Sulfur sources that may be used in the sulfurization reaction of olefins include: elemental sulfur, sulfur monochloride, sulfur dichloride, sodium sulfide, sodium polysulfide, and mixtures of these added together or at different stages of the sulfurization process.

Unsaturated oils, because of their unsaturation, may also be sulfurized and used as an antioxidant. Examples of oils or fats that may be used include corn oil, canola oil, cottonseed oil, grapeseed oil, olive oil, palm oil, peanut oil, coconut oil, rapeseed oil, safflower seed oil, sesame seed oil, soyabean oil, sunflower seed oil, tallow, and combinations of these.

The amount of sulfurized olefin or sulfurized fatty oil delivered to the finished lubricant is based on the sulfur content of the sulfurized olefin or fatty oil and the desired level of sulfur to be delivered to the finished lubricant. For example, a sulfurized fatty oil or olefin containing about 20 weight % sulfur, when added to the finished lubricant at an approximately 1.0 weight % treat level, will deliver 2,000 ppm of sulfur to the finished lubricant. A sulfurized fatty oil or olefin containing about 10 weight % sulfur, when added to the finished lubricant at an approximately 1.0 weight % treat level, will deliver 1,000 ppm sulfur to the finished lubricant. In one embodiment, the sulfurized olefin or sulfurized fatty oil is added to deliver between about 200 ppm and about 2,000 ppm sulfur to the finished lubricant. The foregoing aminic, phenothiazine, and sulfur containing antioxidants are described, for example, in U.S. Pat. No. 6,599,865.

The ashless dialkyldithiocarbamates which may be used as antioxidant additives include, but are not limited to, compounds that are soluble or dispersable in the additive package. In one embodiment, the ashless dialkyldithiocarbamate may be of low volatility, and may have a molecular weight greater than about 250 Daltons. In yet another embodiment, the ashless dialkyldithiocarbamate may a molecular weight greater than about 400 Daltons. Examples of ashless dithiocarbamates that may be used include, but are not limited to, methylenebis(dialkyldithiocarbamate), ethylenebis(dialkyldithiocarbamate), isobutyl disulfide-2,2'-bis (dialkyldithiocarbamate), hydroxyalkyl substituted dialkyldithio-carbamates, dithiocarbamates prepared from unsaturated compounds, dithiocarbamates prepared from norbornylene, and dithiocarbamates prepared from epoxides. In an embodiment, the alkyl groups of the dialkyldithiocarbamate may have from about 1 to about 16 carbons. Non-limiting examples of dialkyldithiocarbamates that may be used are disclosed in the following patents: U.S. Pat. Nos. 5,693,598; 4,876,375; 4,927,552; 4,957,643; 4,885,365; 5,789,357; 5,686,397; 5,902,776; 2,786,866; 2,710,872; 2,384,577; 2,897,152; 3,407,222; 3,867,359; and 4,758,362.

Further examples of ashless dithiocarbamates may include, but are not limited to: methylenebis-(dibutyldithiocarbamate), ethylenebis(dibutyldithiocarbamate), isobutyl disulfide-2,2'-bis(dibutyldithiocarbamate), dibutyl-N,N-dibutyl-(dithiocarbamyl)succinate, 2-hydroxypropyl dibutyldithiocarbamate, Butyl(dibutyldithiocarbamyl)acetate, and S-carbomethoxy-ethyl-N,N-dibutyl dithiocarbamate.

Zinc dialkyl dithiophosphates ("Zn DDPs") are also used in lubricating oils. Zn DDPs have good antiwear and antioxidant properties and have been used to pass cam wear tests, such as the Seq. IVA and TU3 Wear Test. Many patents address the manufacture and use of Zn DDPs including U.S. Pat. Nos. 4,904,401; 4,957,649; and 6,114,288. Non-limiting general Zn. DDP types are primary, secondary and mixtures of primary and secondary Zn DDPs Likewise, organomolybdenum containing compounds used as friction modifiers may also exhibit antioxidant functionality. U.S. Pat. No. 6,797,677 describes a combination of organomolybdenum compound, alkylphenothizine and alkyldiphenylamines for use in finished lubricant formulations. Non-limiting examples of suitable molybdenum containing friction modifiers are described below under "Friction Modifier Components".

The hydrocarbon soluble metal compounds described herein may be used with any or all of the foregoing antioxidants in any and all combinations and ratios. It is understood that various combinations of phenolic, aminic, sulfur containing and molybdenum containing additives may be optimized for the finished lubricant formulation based on bench or engine tests or modifications of the dispersant, VI improver, base oil, or any other additive.

Friction Modifier Components

A sulfur- and phosphorus-free organomolybdenum compound that may be used as a friction modifier may be prepared by reacting a sulfur- and phosphorus-free molybdenum source with an organic compound containing amino and/or alcohol groups. Non-limiting examples of sulfur- and phosphorus-free molybdenum sources include molybdenum trioxide, ammonium molybdate, sodium molybdate and potassium molybdate. The amino groups may include, but are not limited to, monoamines, diamines, or polyamines. The alcohol groups may include, but are not limited to, mono-substituted alcohols, diols or bis-alcohols, or polyalcohols. As an example, the reaction of diamines with fatty oils produces a product containing both amino and alcohol groups that can react with the sulfur- and phosphorus-free molybdenum source.

Non-limiting examples of sulfur- and phosphorus-free organomolybdenum compounds include the following:

1. Compounds prepared by reacting certain basic nitrogen compounds with a molybdenum source as described in U.S. Pat. Nos. 4,259,195 and 4,261,843.

2. Compounds prepared by reacting a hydrocarbyl substituted hydroxy alkylated amine with a molybdenum source as described in U.S. Pat. No. 4,164,473.

3. Compounds prepared by reacting a phenol aldehyde condensation product, a mono-alkylated alkylene diamine, and a molybdenum source as described in U.S. Pat. No. 4,266,945.

4. Compounds prepared by reacting a fatty oil, diethanolamine, and a molybdenum source as described in U.S. Pat. No. 4,889,647.

5. Compounds prepared by reacting a fatty oil or acid with 2-(2-aminoethyl)aminoethanol, and a molybdenum source as described in U.S. Pat. No. 5,137,647.

6. Compounds prepared by reacting a secondary amine with a molybdenum source as described in U.S. Pat. No. 4,692,256.

7. Compounds prepared by reacting a diol, diamino, or amino-alcohol compound with a molybdenum source as described in U.S. Pat. No. 5,412,130.

8. Compounds prepared by reacting a fatty oil, mono-alkylated alkylene diamine, and a molybdenum source as described in U.S. Pat. No. 6,509,303.

9. Compounds prepared by reacting a fatty acid, mono-alkylated alkylene diamine, glycerides, and a molybdenum source as described in U.S. Pat. No. 6,528,463.

Molybdenum compounds prepared by reacting a fatty oil, diethanolamine, and a molybdenum source as described in U.S. Pat. No. 4,889,647 are sometimes illustrated with the following structure, where R is a fatty alkyl chain, although the exact chemical composition of these materials is not fully known and may in fact be multi-component mixtures of several organomolybdenum compounds.

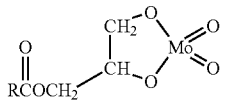

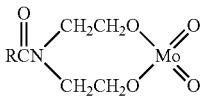

Sulfur-containing organomolybdenum compounds may be used and may be prepared by a variety of methods. One method involves reacting a sulfur and phosphorus-free molybdenum source with an amino group and one or more sulfur sources. Sulfur sources can include for example, but are not limited to, carbon disulfide, hydrogen sulfide, sodium sulfide and elemental sulfur. Alternatively, the sulfur-containing molybdenum compound may be prepared by reacting a sulfur-containing molybdenum source with an amino group or thiuram group and optionally a second sulfur source. Examples of sulfur- and phosphorus-free molybdenum sources include molybdenum trioxide, ammonium molybdate, sodium molybdate, potassium molybdate, and molybdenum halides. The amino groups may be monoamines, diamines, or polyamines. As an example, the reaction of molybdenum trioxide with a secondary amine and carbon disulfide produces molybdenum dithiocarbamates. Alternatively, the reaction of $(NH_4)_2Mo_3S_{13}*n(H_2O)$ where n varies between 0 and 2, with a tetralkylthiuram disulfide, produces a trinuclear sulfur-containing molybdenum dithiocarbamate.

Examples of sulfur-containing organomolybdenum compounds appearing in patents and patent applications include the following:

1. Compounds prepared by reacting molybdenum trioxide with a secondary amine and carbon disulfide as described in U.S. Pat. Nos. 3,509,051 and 3,356,702.

2. Compounds prepared by reacting a sulfur-free molybdenum source with a secondary amine, carbon disulfide, and an additional sulfur source as described in U.S. Pat. No. 4,098,705.

3. Compounds prepared by reacting a molybdenum halide with a secondary amine and carbon disulfide as described in U.S. Pat. No. 4,178,258.

4. Compounds prepared by reacting a molybdenum source with a basic nitrogen compound and a sulfur source as described in U.S. Pat. Nos. 4,263,152, 4,265,773, 4,272,387, 4,285,822, 4,369,119, and 4,395,343.

5. Compounds prepared by reacting ammonium tetrathiomolybdate with a basic nitrogen compound as described in U.S. Pat. No. 4,283,295.

6. Compounds prepared by reacting an olefin, sulfur, an amine and a molybdenum source as described in U.S. Pat. No. 4,362,633.

7. Compounds prepared by reacting ammonium tetrathiomolybdate with a basic nitrogen compound and an organic sulfur source as described in U.S. Pat. No. 4,402,840.

8. Compounds prepared by reacting a phenolic compound, an amine and a molybdenum source with a sulfur source as described in U.S. Pat. No. 4,466,901.

9. Compounds prepared by reacting a triglyceride, a basic nitrogen compound, a molybdenum source, and a sulfur source as described in U.S. Pat. No. 4,765,918.

10. Compounds prepared by reacting alkali metal alkylthioxanthate salts with molybdenum halides as described in U.S. Pat. No. 4,966,719.

11. Compounds prepared by reacting a tetralkylthiuram disulfide with molybdenum hexacarbonyl as described in U.S. Pat. No. 4,978,464.

12. Compounds prepared by reacting an alkyl dixanthogen with molybdenum hexacarbonyl as described in U.S. Pat. No. 4,990,271.

13. Compounds prepared by reacting alkali metal alkylxanthate salts with dimolybdenum tetra-acetate as described in U.S. Pat. No. 4,995,996.

14. Compounds prepared by reacting $(NH_4)_2Mo_3S_{13}*2H_2O$ with an alkali metal dialkyldithiocarbamate or tetralkyl thiuram disulfide as described in U.S. Pat. No. 6,232,276.

15. Compounds prepared by reacting an ester or acid with a diamine, a molybdenum source and carbon disulfide as described in U.S. Pat. No. 6,103,674.

16. Compounds prepared by reacting an alkali metal dialkyldithiocarbamate with 3-chloropropionic acid, followed by molybdenum trioxide, as described in U.S. Pat. No. 6,117,826.

Molybdenum dithiocarbamates may be illustrated by the following structure,

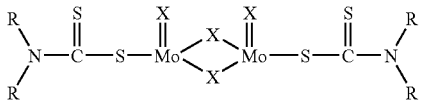

where R is an alkyl group containing about 4 to about 18 carbons or H, and X is O or S.

Glycerides may also be used alone or in combination with other friction modifiers. Suitable glycerides include, but are not limited to, glycerides of the formula:

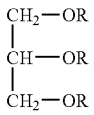

wherein each R is independently selected from the group consisting of H and C(O)R' where R' may be a saturated or an unsaturated alkyl group having from about 3 to about 23 carbon atoms. Non-limiting examples of glycerides that may be used include glycerol monolaurate, glycerol monomyristate, glycerol monopalmitate, glycerol monostearate, and mono-glycerides derived from coconut acid, tallow acid, oleic acid, linoleic acid, and linolenic acids. Typical commercial monoglycerides contain substantial amounts of the corresponding diglycerides and triglycerides. These materials are not detrimental to the production of the molybdenum compounds, and may in fact be more active. Any ratio of mono- to di-glyceride may be used. In an embodiment, from about 30 to about 70% of the available sites contain free hydroxyl groups (i.e., 30 to 70% of the total R groups of the glycerides represented by the above formula are hydrogen). In another embodiment, the glyceride is glycerol monooleate, which is generally a mixture of mono, di, and tri-glycerides derived from oleic acid, and glycerol.

Other Components

Rust inhibitors selected from the group consisting essentially of nonionic polyoxyalkylene polyols and esters thereof, polyoxyalkylene phenols, and anionic alkyl sulfonic acids may be used.

A small amount of a demulsifying component may be used. A preferred demulsifying component is described in EP Pat. No. 330,522, the disclosure of which is herein incorporated by reference. Such demulsifying component may be obtained by reacting an alkylene oxide with an adduct obtained by reacting a bis-epoxide with a polyhydric alcohol. The demulsifier should be used at a level not exceeding 0.1 mass % active ingredient. In an embodiment, a treat rate of about 0.001 to about 0.05 mass % active ingredient may be used.

Pour point depressants, otherwise known as lube oil flow improvers, lower the minimum temperature at which the fluid will flow or can be poured. Such additives are well known. Non-limiting examples of pour point depressant additives which improve the low temperature fluidity of the fluid are about $C_8$ to about $C_{18}$ dialkyl fumarate/vinyl acetate copolymers, polyalkylmethacrylates and the like.

Foam control can be provided by many compounds including, but not limited to, an antifoamant of the polysiloxane type, for example, silicone oil or polydimethyl siloxane.

Seal swell agents, as described, but not limited to, for example, in U.S. Pat. Nos. 3,794,081 and 4,029,587, may also be used.

Viscosity modifiers (VM) function to impart high and low temperature operability to a lubricating oil. The VM used may have that sole function, or may be multifunctional.

Multifunctional viscosity modifiers that also function as dispersants are also known. Non-limiting examples of suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Functionalized olefin copolymers that may also be used include interpolymers of ethylene and propylene which are grafted with an active monomer such as maleic anhydride and then derivatized with an alcohol or amine. Other such copolymers are copolymers of ethylene and propylene which are grafted with nitrogen compounds.

Each of the foregoing additives, when used, is used at a functionally effective amount to impart the desired properties to the lubricant. Thus, for example, if an additive is a corrosion inhibitor, a functionally effective amount of this corrosion inhibitor would be an amount sufficient to impart the desired corrosion inhibition characteristics to the lubricant. Generally, the concentration of each of these additives, when used, ranges up to about 20% by weight based on the weight of the lubricating oil composition, and in one embodiment from about 0.001% to about 20% by weight, and in one embodiment about 0.01% to about 10% by weight based on the weight of the lubricating oil composition.

The hydrocarbon soluble titanium additives may be added directly to the lubricating oil composition. In one embodiment, however, they are diluted with a substantially inert, normally liquid organic diluent such as mineral oil, synthetic oil, naphtha, alkylated (e.g. $C_{10}$ to $C_{13}$ alkyl) benzene, toluene or xylene to form an additive concentrate. These concentrates usually contain from about 1% to about 100% by weight and in one embodiment about 10% to about 90% by weight of the titanium compound.

Base Oils

Base oils suitable for use in formulating the compositions, additives and concentrates described herein may be selected from any of the synthetic, natural and mineral oils, or mixtures thereof. Non-limiting examples of synthetic base oils include alkyl esters of dicarboxylic acids, polyglycols and alcohols, poly-alpha-olefins, including polybutenes, alkyl benzenes, organic esters of phosphoric acids, polysilicone oils, and alkylene oxide polymers, interpolymers, copolymers and derivatives thereof where the terminal hydroxyl groups have been modified by esterification, etherification, and the like.

Natural base oils include, but are not limited to, animal oils and vegetable oils (e.g., castor oil, lard oil), liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils. In an embodiment, the base oil typically has a viscosity of about 2.5 to about 15 cSt. In another embodiment, the base oil has a viscosity of about 2.5 to about 11 cSt at 100° C. Such base oils include those conventionally employed as crankcase lubricating oils for spark-ignited and compression-ignited internal combustion engines, such as automobile and truck engines, marine and railroad diesel engines, and the like. These base oils are typically classified as Group I, Group II, Group III, Group IV and Group V. The above mentioned base oils are described above in Table 1.

The following examples are given for the purpose of exemplifying aspects of the embodiments and are not intended to limit the embodiments in any way.

EXAMPLE 1

Synthesis of Titanium Neodecanoate

Neodecanoic acid (about 600 grams) was placed into a reaction vessel equipped with a condenser, Dean-Stark trap, thermometer, thermocouple, and a gas inlet. Nitrogen gas was bubbled into the acid. Titanium isopropoxide (about 245 grams) was slowly added to the reaction vessel with vigorous stirring. The reactants were heated to about 140° C. and stirred for one hour. Overheads and condensate from the reaction were collected in the trap. A subatmospheric pressure was applied to the reaction vessel and the reactants were stirred for about an additional two hours until the reaction was complete. Analysis of the product indicated that the product had a kinematic viscosity of about 14.3 cSt at about 100° C. and a titanium content of about 6.4 percent by weight.

EXAMPLE 2

Synthesis of Titanium Oleate

Oleic acid (about 489 grams) was placed into a reaction vessel equipped with a condenser, Dean-Stark trap, thermometer, thermocouple, and a gas inlet. Nitrogen gas was bubbled into the acid. Titanium isopropoxide (about 122.7 grams) was slowly added to the reaction vessel with vigorous stirring. The reactants were heated to about 140° C. and stirred for one hour. Overheads and condensate from the reaction were collected in the trap. A subatmospheric pressure was applied to the reaction vessel and the reactants were stirred for about an additional two hours until the reaction was complete. Analysis of the product indicated that the product had a kinematic viscosity of about 7.0 cSt at about 100° C. and a titanium content of about 3.8 percent by weight.

EXAMPLE 3

Friction Coefficient Effects of Hydrocarbon Soluble Titanium Additives

In the following example, titanium oleate was added to a GF-4 formulated lubricant composition to provide titanium metal in amount of about 0 or about 1,000 ppm based on the finished lubricant. Combinations of the lubricant with and without an organomolybdenum compound and/or a glycerol ester were also prepared and tested. The coefficient of friction was determined at about 130° C. in a high frequency reciprocating test rig. The finished lubricant had a kinematic viscosity at about 100° C. of about 8.55 cSt, a cold crank start viscosity (CCS) of about 3,752 centipoise at about −30° C., and contained the following components in the approximate amounts indicated in the following table:

TABLE 2

| Finished Lubricant | |
|---|---|
| Component | Amount (wt. %) |
| 2100 molecular weight succinimide dispersant | 1.5 |
| 1300 molecular weight succinimide dispersant | 4.3 |
| 150 Solvent Neutral diluent oil | 0.464 |
| Antifoam agent | 0.006 |
| Aromatic amine antioxidant | 0.8 |
| Sulfurized alpha-olefin antioxidant | 0.8 |
| 300 TBN Overbased calcium sulfonates detergent | 1.8 |
| Polymethacrylate pour point depressant | 0.1 |
| Mixed primary and secondary Zinc dialkyldithiophosphate | 0.93 |
| Olefin copolymer viscosity index improver | 6.3 |
| Group II, 110 N, Base Oil | 5.0 |
| Group II, 225 N, Base Oil | 5.0 |
| Group III base oil | 72.65 |
| Total | 99.65 |

The following table lists the results of the friction tests using no friction modifier, and one or more friction modifiers with and without the titanium oleate. The molybdenum compound was an organomolybdenum complex available from R. T. Vanderbilt Company, Inc. of Norwalk, Conn. under the trade name MOLYVAN® 855 and was present in the finished oil at about 0.05 wt. %. When the glycerol monooleate was used, it was present in the finished oil at about 0.3 wt. %.

TABLE 3

Friction Data for Finished Oil

| Run No. | | Friction Coefficient | Standard Deviation |
|---|---|---|---|
| 1 | No titanium, no moly, no glycerol monooleate | 0.137 | 0.003 |
| 2 | Moly and glycerol monooleate, no titanium | 0.090 | — |
| 3 | Titanium, no moly, no glycerol monooleate | 0.098 | 0.001 |
| 4 | Titanium, moly, and glycerol monooleate | 0.081 | 0.002 |

As seen by the results in Table 2, titanium oleate alone (Run 3) provided a significant reduction in the friction coefficient of the lubricant as compared to the base oil (Run 1) that contained no friction modifier. When the titanium oleate was combined with the molybdenum compound and the glycerol monooleate friction modifiers (Run 4), the lowest friction coefficient was obtained. Run 2 provided an example of a base oil containing only the molybdenum compound and the glycerol monooleate friction modifiers.

EXAMPLE 3

In this example, the base oil listed in Table 2 was spiked with titanium oleate to provide from about 0 to about 1,000 ppm titanium metal in the finished lubricant. The base oil also contained glycerol monooleate and MOLYVAN® 855. The results of the friction coefficient runs conducted as described above are given in the following table:

TABLE 3

Friction Data for Titanium Spiked Oil

| Run No. | Glycerol Monooleate (wt. %) | MOLYVAN ®855 (wt. %) | Titanium (ppm) | Friction Coefficient | Standard Deviation |
|---|---|---|---|---|---|
| 1 | 0.3 | 0.05 | 0 | 0.098 | 0.001 |
| 2 | 0.295 | 0.0492 | 600 | 0.080 | 1.001 |
| 3 | 0.293 | 0.0489 | 800 | 0.080 | 0.000 |
| 4 | 0.292 | 0.0487 | 1000 | 0.081 | 0.002 |

As shown by the foregoing results, an amount of titanium metal in the finished lubricant (ranging from about 600 to about 1,000 ppm in Runs 2-4) has a significant effect on the friction coefficient compared to a base oil (Run 1) that did not contain the titanium oleate.

EXAMPLE 4

In this example, the base oil listed in Table 2, with the exception that it contained about 73 wt. % of the Group III base oil was spiked with titanium oleate to provide from about 0 to about 1,000 ppm titanium metal in the finished lubricant. The base oil contained no glycerol monooleate and no MOLYVAN® 855. A ball rust corrosion bench test was conducted on the lubricants to determine if the titanium additive had any significant effect on corrosion. The results are given in the following table:

TABLE 4

Ball Rust Corrosion Bench Test For Titanium Spiked Oil

| Run No. | Titanium Oleate (wt. %) | Titanium (ppm) | Average Gray Value |
|---|---|---|---|
| 1 | 0 | 0 | 137 |
| 2 | 1.58 | 600 | 136 |
| 3 | 2.10 | 800 | 131 |
| 4 | 2.63 | 1000 | 100/104* |

*Repeat run

As shown by the foregoing results, titanium in amounts ranging from about 600 to about 1000 ppm (Runs 2-3) had little adverse effect on corrosion as indicated by the foregoing test. Results were similar to oils containing no titanium oleate friction modifier (Run 1). Although Run 4 corrosion results were lower than the other test results, it still passed the minimum requirement for GF-4 oils of 100 average gray value.

It is expected that formulations containing from about 50 to about 1,000 ppm or more titanium metal in the form of a hydrocarbon soluble titanium compound will enable a reduction in conventional phosphorus and sulfur antiwear agents thereby maintaining the effectiveness the performance of pollution control equipment on vehicles while achieving a similar or improved friction coefficient performance or benefit and little or no adverse effect on the corrosiveness of the oil.

At numerous places throughout this specification, reference has been made to a number of U.S. Patents and publications. All such cited documents are expressly incorporated in full into this disclosure as if fully set forth herein.

The foregoing embodiments are susceptible to considerable variation in its practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. A lubricated surface comprising a lubricant composition containing a base oil of lubricating viscosity and an amount of at least one hydrocarbon soluble titanium compound effective to provide a reduction in the coefficient of friction of the lubricant composition greater than a reduction in the coefficient of friction of the lubricant composition devoid of the hydrocarbon soluble titanium compound, wherein the hydrocarbon soluble titanium compound is derived from a titanium alkoxide and a carboxylic acid selected from the group consisting of a non-linear mono-carboxylic acid and a carboxylic acid having more than 22 up to 25 carbon atoms, and wherein the amount of hydrocarbon soluble titanium compound provides an amount of titanium ranging from about 10 to about 1500 ppm to the lubricant composition.

2. The lubricated surface of claim 1, wherein the lubricated surface comprises an engine drive train.

3. The lubricated surface of claim 1, wherein the lubricated surface comprises an internal surface or component of an internal combustion engine.

4. The lubricated surface of claim 1, wherein the lubricated surface comprises an internal surface or component of a compression ignition engine.

5. The lubricated surface of claim 1, wherein the amount of hydrocarbon soluble titanium compound provides an amount of titanium ranging from above about 50 to about 500 ppm in the lubricant composition.

6. The lubricated surface of claim 1, wherein the hydrocarbon soluble titanium compound comprises a reaction product of a titanium isopropoxide and neodecanoic acid.

7. The lubricated surface of claim 1, wherein the hydrocarbon soluble titanium compound comprises a titanium carboxylate derived from a non-linear mono-carboxylic acid containing at least about 6 carbon atoms.

8. A motor vehicle comprising the lubricated surface of claim 1.

9. The vehicle of claim 8, wherein the amount of hydrocarbon soluble titanium compound provides from above about 50 to about 500 parts per million titanium in the lubricant.

10. A heavy duty diesel engine having moving parts and containing a lubricant for lubricating the moving parts, the lubricant comprising an oil of lubricating viscosity, a first friction modifier selected from the group consisting essentially of an organomolybdenum friction modifier, a glycerol ester friction modifier, and mixtures thereof, and a second friction modifier comprising an amount of at least one hydrocarbon soluble titanium compound effective to provide a reduction in the friction coefficient of the lubricant greater than a reduction in the friction coefficient of the lubricant devoid of the hydrocarbon soluble titanium compound, wherein the titanium compound is derived from a titanium alkoxide and carboxylic acid selected from the group consisting of a non-linear mono-carboxylic acid and a carboxylic acid having more than 22 up to 25 carbon atoms, and wherein the compound is essentially devoid of sulfur and phosphorus atoms, and wherein the amount of hydrocarbon soluble titanium compound provides an amount of titanium ranging from about 10 to about 1500 ppm to the lubricant.

11. The vehicle of claim 10, wherein the hydrocarbon soluble titanium compound comprises a reaction product of a titanium isopropoxide and neodecanoic acid.

12. A fully formulated lubricant composition comprising a base oil component of lubricating viscosity, a first friction modifier selected from the group consisting essentially of an organomolybdenum friction modifier, a glycerol ester friction modifier, and mixtures thereof, and a second friction modifier comprising an amount of hydrocarbon soluble titanium-containing agent effective to provide a reduction in the coefficient of friction of the lubricant composition greater than a reduction in the coefficient of friction of the lubricant composition devoid of the hydrocarbon soluble titanium-containing agent, wherein the titanium-containing agent is a reaction product of a titanium alkoxide and a carboxylic acid selected from the group consisting of a non-linear mono-carboxylic acid and a carboxylic acid having more than 22 up to 25 carbon atoms, and wherein the titanium-containing agent is essentially devoid of sulfur and phosphorus atoms, and wherein the amount of hydrocarbon soluble titanium-containing agent provides an amount of titanium ranging from about 10 to about 1500 ppm to the lubricant composition.

13. The lubricant composition of claim 12 wherein the lubricant composition comprises a low ash, low sulfur, and low phosphorus lubricant composition suitable for compression ignition engines such that the finished oil contains about 0.7 wt % or less sulfur and about 0.12 wt % or less phosphorus.

14. The lubricant composition of claim 12, wherein the hydrocarbon soluble titanium-containing agent comprises a reaction product of a titanium alkoxide and neodecanoic acid.

15. The lubricant composition of claim 12, wherein the amount of hydrocarbon soluble titanium-containing agent provides from above about 50 to about 500 parts per million titanium to the lubricant composition.

16. A method of reducing the friction coefficient of engine lubricant compositions during operation of an engine containing the lubricant composition, comprising contacting the engine parts with a lubricant composition comprising a base oil of lubricating viscosity and an amount of a hydrocarbon soluble titanium compound effective to provide a reduction in the friction coefficient of the lubricant composition greater than a reduction in the friction coefficient of the lubricant composition devoid of the hydrocarbon soluble titanium compound, wherein the hydrocarbon soluble titanium compound is derived from a titanium alkoxide and a carboxylic acid selected from the group consisting of a non-linear mono-carboxylic acid and a carboxylic acid having more than 22 up to 25 carbon atoms, and wherein the titanium compound is substantially devoid of sulfur, and phosphorus atoms, and wherein the amount of hydrocarbon soluble titanium compound provides an amount of titanium ranging from above about 10 to about 1500 ppm in the lubricant composition.

17. The method of claim 16 wherein the engine comprises a heavy duty diesel engine.

18. The method of claim 16, wherein the hydrocarbon soluble titanium compound comprises a reaction product of a titanium isopropoxide and neodecanoic acid.

19. The method of claim 16, wherein the lubricant composition further comprises a second friction modifier selected from the group consisting essentially of an organomolybdenum friction modifier, a glycerol ester friction modifier, and a mixture thereof.

20. A method of lubricating moving parts of an engine with a lubricating oil, the method comprising using as the lubricating oil for one or more moving parts a lubricant composition containing a base oil, a first friction modifier selected from the group consisting essentially of an organomolybdenum friction modifier, a glycerol ester friction modifier, and mixtures thereof, and a second friction modifier comprising a reaction product of a titanium alkoxide and a carboxylic acid selected from the group consisting of a non-linear mono-carboxylic acid and a carboxylic acid having more than 22 up to 25 carbon atoms, wherein the second friction modifier is effective to provide from about 10 to about 1500 parts per million titanium in the lubricating oil, and wherein the second friction modifier is substantially devoid of sulfur, and phosphorus atoms.

21. The method of claim 20, wherein the moving parts comprise moving parts of an engine.

22. The method of claim 21, wherein the engine is selected from the group consisting essentially of a compression ignition engine and a spark ignition engine.

23. The method of claim 21, wherein the engine includes an internal combustion engine having a crankcase and wherein the lubricating oil comprises a crankcase oil present in the crankcase of the engine.

24. The method of claim 21, wherein the lubricating oil comprises a drive train lubricant present in a drive train of a vehicle containing the engine.

* * * * *